US006131217A

United States Patent [19]

Kasem

[11] Patent Number: 6,131,217

[45] Date of Patent: Oct. 17, 2000

[54] CONVERTIBLE CANOPY CRIB

[76] Inventor: Jean Kasem, 138 Mapleton, Los Angeles, Calif. 90077

[21] Appl. No.: 09/238,485

[22] Filed: Jan. 27, 1999

[51] Int. Cl.[7] ..... A47D 7/00

[52] U.S. Cl. ..... 5/93.1; 5/97; 5/100

[58] Field of Search ..... 5/93.1, 93.2, 97, 5/100; D6/390, 389; 135/124, 100, 125, 135

[56] References Cited

U.S. PATENT DOCUMENTS 2,731,972 1/1956 Braun ..... 135/125
5,706,533 1/1998 Opheim et al. ..... 5/100 X

FOREIGN PATENT DOCUMENTS 729837 5/1961 Canada ..... 5/97

OTHER PUBLICATIONS

3 Pages from Little Miss Liberty Round Crib Company (LMLRCC) Catalog, dated Jun. 1996.
Assembly Instructions for Standard/Canopy Top Round Wood Crib, LMLRCC, dated Jun. 1996.
Assembly Instructions for Round Crib Bedding Ensemble, Little Miss Liberty of Beverly Hills, dated Jun. 1996.

*Primary Examiner*—Terry Lee Melius
*Assistant Examiner*—James M Hewitt
*Attorney, Agent, or Firm*—Blakely, Sokoloff, Taylor & Zafman LLP

[57] ABSTRACT

A method of converting a canopy crib to a standard crib, particularly useful for cribs made of wood. A canopy assembly is removably connected on top of a crib assembly. The canopy assembly has a number of canopy legs that removably fit over and cover respective supports on the crib assembly. The canopy assembly may be removed by pulling the canopy legs off the supports to expose the supports and then separately covering the supports with caps. In a particular embodiment, the canopy crib has a pair of movable side members opposite each other, a pair of angled rods extending vertically through on either side of each one of the movable side members is used to secure a respective pair of caps to their respective supports. Each rod has an end portion which is fastened to an adjacent cap and support to secure the cap, in a rotation free manner, to the support. The same mechanism may also be used to secure the canopy leg to the support.

19 Claims, 2 Drawing Sheets

CONVERTIBLE CANOPY CRIB

RELATED APPLICATIONS

The subject matter of this patent application is related to the following U.S. patent applications of Jean Kasem, "METHOD AND APPARATUS FOR CONVERTING A CANOPY CRIB TO A STANDARD CRIB" (P005), and "CANOPY ASSEMBLY HAVING UNIVERSAL COMPONENTS FOR DIFFERENT TYPES OF CANOPIES" (P006) which are filed on the same date as this application and which are incorporated by reference herein as if they were set forth in their entirety herein.

BACKGROUND INFORMATION

1. Field of the Invention

This invention is generally related to cribs and more particularly to converting a canopy crib into a standard crib.

2. Description of the Related Art

Canopy cribs are very popular with couples who wish to have a unique sleeping area for their baby. As compared with a standard crib, the canopy crib has a raised canopy that is suspended over the sleeping area of the baby. The canopy as defined in this disclosure may be of different shapes, such as flat, convex (similar to a dome), concave (sometimes called fluted dome), and cone. Many people prefer the standard crib, which does not have any overhanging canopy, for a baby boy, and the canopy crib for a baby girl. Thus, when a couple initially has a baby girl and elects to purchase a canopy crib, and then subsequently has a baby boy, they may be forced to purchase a separate standard crib for their little boy. Therefore, to reduce the cost of a crib for such couples, there is a need for a canopy crib which can be easily converted into a standard crib, and vice versa. Such a canopy crib should also be cost-efficient to manufacture.

SUMMARY

Accordingly, an embodiment of the invention is directed at a method of converting a canopy crib to a standard crib, and vice versa. The canopy crib includes a canopy assembly that is removably connected to a crib assembly. The canopy assembly includes a number of canopy legs that are removably connected to the crib assembly to support the canopy assembly on top of the crib assembly. The crib assembly has a number of supports, where a lower portion of each of the canopy legs removably fits over one of the respective supports. The method includes removing the canopy assembly by exposing the respective supports, and then covering each of the supports with a cap.

These as well as other features and advantages of the invention can be better appreciated by referring to the drawings, written description, and claims below.

DETAILED DESCRIPTION

As summarized above, an embodiment of the invention is directed at an efficient method of converting a canopy crib into a standard crib. This permits a parent to make only a single purchase for a canopy crib as well as a standard crib. The procedure to change from canopy crib to standard crib will include simply removing the canopy assembly and then covering any exposed supports that were used to support the canopy assembly.

Figure 1:
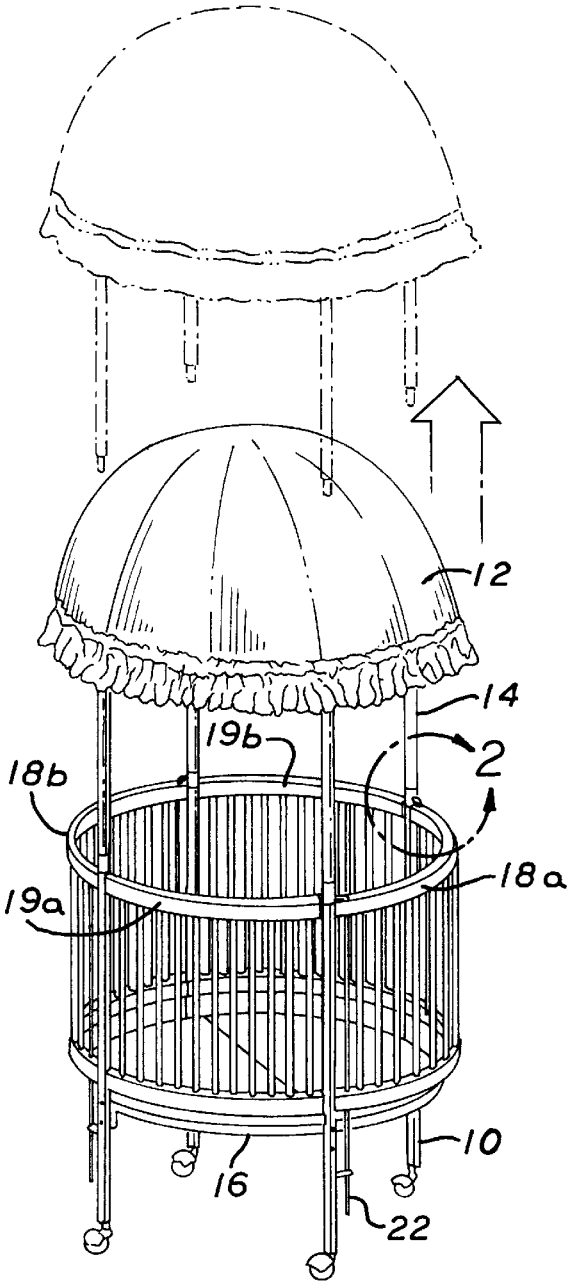
FIG. 1 illustrates a perspective view of a canopy crib conversion according to an embodiment of the invention.

FIG. 1 shows a perspective view of a convertible canopy crib according to an embodiment of the invention. A canopy assembly includes a canopy 12 made of cloth or other material that is supported by a frame (not shown) according to conventional techniques. The canopy 12 is not limited to the dome shape shown but may alternatively be of a variety of different shapes, including flat, concave (so-called fluted dome), or cone. The frame is attached using well known techniques in the art to a number of canopy legs 14, or using the techniques described in Jean Kasem's U.S. patent application entitled "CANOPY ASSEMBLY HAVING UNIVERSAL COMPONENTS FOR DIFFERENT TYPES OF CANOPIES" (P006) filed on the same date as this application. The canopy legs 14 are in turn connected to a crib assembly. The crib assembly comprises a base 16 surrounded by a number of crib side members 18*a,* 18*b,* 19*a,* and 19*b* which extend upwards from the base to help contain a baby inside the crib assembly. A mattress (not shown) would also be lying against the base 16. The side members 18 and 19 are tall enough such that the baby is not able to crawl outside of the crib. The crib assembly is supported by a number of crib legs 10. The crib assembly can be implemented according to conventional techniques, such as connecting the adjacent side members to a crib leg therebetween and connecting the base to the crib legs. In addition, the two side members 18*a* and 18*b* which oppose each other are movable in a vertical direction. The other side members 19*a* and 19*b* are normally fixed. The movable side members when lowered permit the baby to be placed into and removed from the crib without having to lift the baby as high as the top of the crib. Each movable side member 18 is guided by a pair of rods 22 that extend vertically through on either side of the movable side member. The top portion of the rod 22 is angled and looped as shown in FIG. 2, and is attached to a support 28 which is stationary with respect to the movable side members 18*a* and 18*b*.

Figure 2:
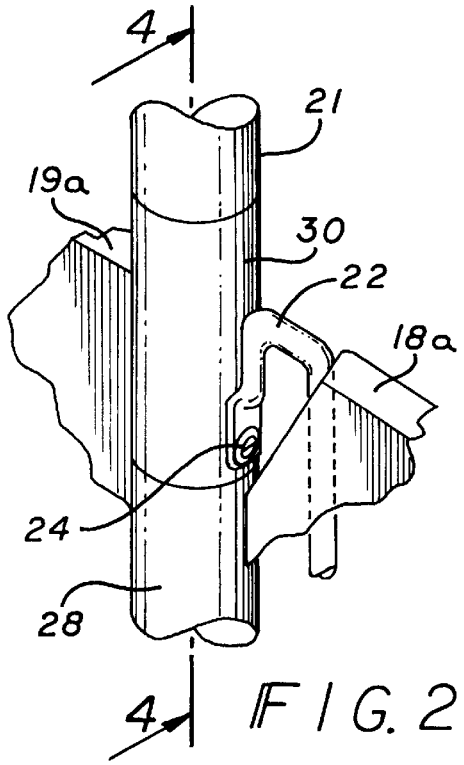
FIG. 2 illustrates a perspective view of the structure for removably supporting a canopy assembly atop a crib assembly.

FIG. 2 shows a perspective view of the means for removably supporting the canopy assembly, according to an embodiment of the invention. The canopy leg 14 includes a post 21 and a sleeve 30. The sleeve 30 has a bottom portion that is sized to fit over and against the support 28 of the crib assembly, to support the canopy assembly. The support 28 is between movable side member 18*a* and stationary side member 19*a*. A hollow inside the support 28 and a corresponding hole in the sleeve 30 are sized to receive a bolt 24 through a flattened portion of the rod 22. This technique for securing the canopy assembly to the support 28 is shown in FIG. 4 in cross-section.

Figure 4:
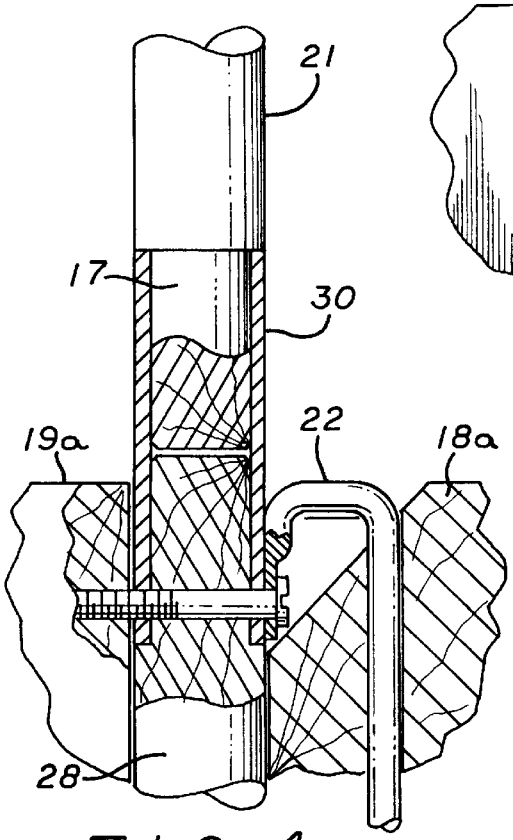
FIG. 4 illustrates a cross-sectional view of the structure for removably supporting the canopy assembly.

In FIG. 4, the sleeve 30 is glued or otherwise permanently attached to the bottom portion of the post 21. The bottom portion of the post 21 is narrowed to yield a shoulder against which the top of the sleeve 30 is set. The top portion of the support is similarly narrowed to receive the bottom portion of the sleeve. The sleeve 30 is preferably made of a metal, such as brass, or other high strength material. A pair of aligned holes one on either side of the sleeve 30 and a corresponding opening in the support 28 receive the bolt 24 which threads into the stationary side member 19*a* to fasten the rod 22, the sleeve 30 and the side member 19*a* to the support 28. An advantage of the structure shown in FIG. 2 and in FIG. 4 is that it facilitates fitting the post 21 against the support 28 when both the post and the support, as well as perhaps the rest of the crib, are made of wood, without significantly affecting the all-wood appearance of the crib. In another embodiment of the invention, the support 28 is actually a top portion of a respective one of the crib legs 10. In this embodiment, virtually the entire crib assembly, except perhaps the rods 22 and caps 32, may be made of wood. The cap 32 may be made of the same material as the sleeve 30.

Removing the canopy assembly thus becomes a simple task of lowering the movable side 18*a,* removing the bolt 24 from the sleeve 30, and pulling the canopy legs 14 vertically upwards, by, for instance, grasping each post 21 and pulling upwards, to fully expose the support 28. If desired, the canopy 12 and its underlying frame may first be removed from the legs 14 in a piece-by-piece manner, leaving only the canopy legs 14 connected to the crib assembly. Thereafter, each canopy leg 14 may be pulled off its respective support 28. Alternatively, the canopy assembly can be removed as a whole, using two persons, one on either side of the crib, with each person grasping two of the four posts 21 and simultaneously pulling upwards.

Figure 3:
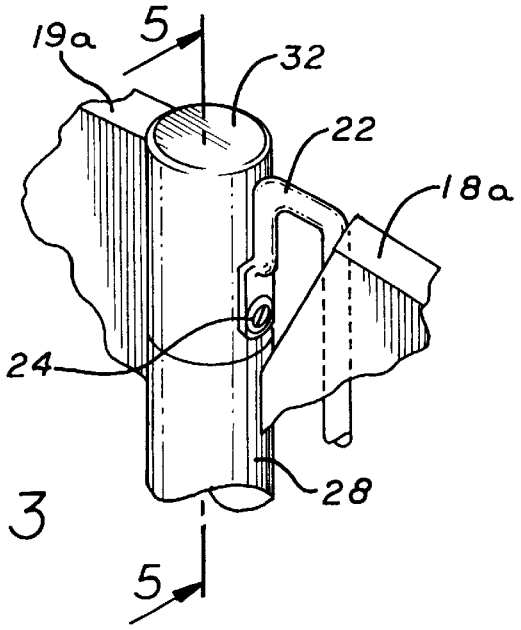
FIG. 3 shows a covered support in the crib assembly once the canopy assembly has been removed.

Turning now to FIG. 3, once the canopy assembly has been removed, the supports 28 of the crib assembly which have been exposed as a result are then covered by, for instance, placing a cap 32 over each respective support 28. In a preferred embodiment of the invention, the cap 32 that covers the supports 28 cannot be rotated with respect to the region surrounding the support 28 on the crib assembly. To achieve this result, the bolt 24 is reinserted through the flat end of the angled top portion of the rod 22 into a hole in the cap 32 and the hollow in the support 28. This helps secure the cap 32 to the support 28 as well as prevent the cap 32 from being rotated.

Figure 5:
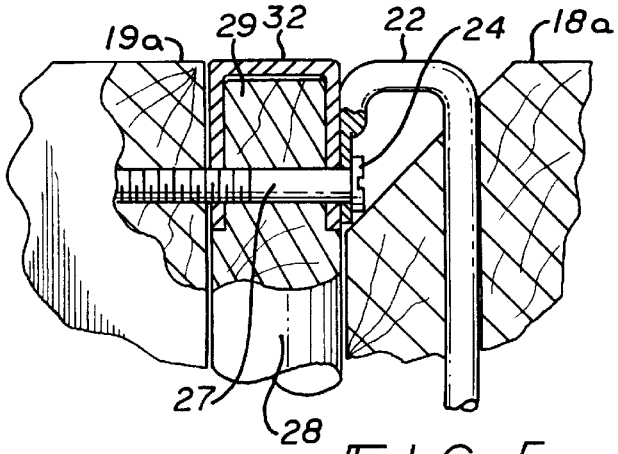
FIG. 5 shows a cross-sectional view of a covered support.
Figure 6:
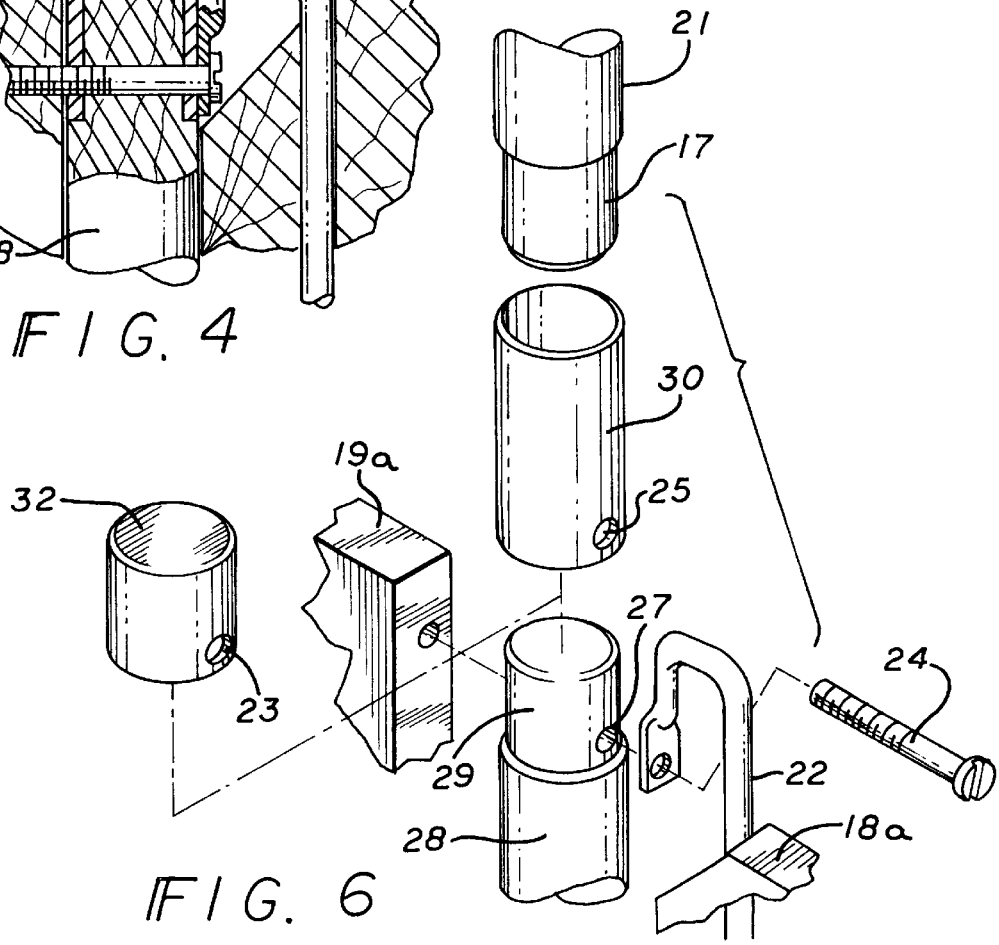
FIG. 6 is an exploded view of a mechanism for removably connecting a canopy assembly to a crib assembly.

The use of the angled rod 22 as shown in FIGS. 2 and 3 and in FIGS. 4 and 5 thus provides an efficient technique for both securing the canopy assembly to the crib assembly, as well as for covering the exposed support 28 when the canopy assembly has been removed, while keeping the cap 32 and the canopy leg 14 from being rotated. In the preferred embodiment of the invention, the angled rod 22, the movable side member 18*a,* the stationary side member 19*a,* the support 28, and the cap 32 are sized such that their tops are essentially at the same level as shown in FIG. 5, or where the top of the cap 32 is no more than ⅛ inch above the other components. The various components of the canopy crib described above and again shown in an exploded view in FIG. 6 may be sold as a kit together with instructions to connect the different components together using well known fastening techniques.

To summarize, a novel method of converting a canopy crib to a standard crib has been disclosed. Various embodiments of the invention have been described with reference to the figures above. However, one of ordinary skill in the art will recognize that the invention is capable of use in various other combinations and is capable of changes and modifications within the scope of the inventive concept expressed here. For instance, although the embodiment of the invention illustrated in FIG. 1 shows a round crib, the canopy to standard conversion techniques described may also be applied to rectangular cribs. Accordingly, it is intended that all such modifications and/or changes be within the scope of the claims.

What is claimed is:

1. A method of converting a canopy crib comprising removing a canopy assembly to expose a plurality of supports;

placing a plurality of caps over said supports;

fastening an angled rod to one of the supports through a hole in one of the plurality of caps and an opening in one of the supports.

2. The method of claim 1 wherein the step of removing includes pulling said canopy legs vertically upwards.

3. A convertible crib comprising:

a crib assembly having a crib base, a crib side connected to the base and extending upwards therefrom, and a plurality of supports connected to the crib side, the crib side having a plurality of elongated bars spaced around the base to prevent a child lying on the base from removing herself from the base; and a canopy assembly having a canopy and a plurality of canopy legs, the legs being removably connected to a top of the crib assembly at one end and to a bottom of the canopy at another end to support the canopy above the crib assembly, a lower portion of each of the canopy legs removably connects to a respective one of the supports with an opening defined between an adjacent pair of said canopy legs, the bottom of the canopy, and the top of the crib side that allows the placement and removal of the child there through.

4. The crib of claim 3 wherein the lower portion of each of the canopy legs fits over the respective support.

5. The crib of claim 3 wherein each canopy leg includes a post and a sleeve, the sleeve having a top portion permanently joined to a bottom portion of the post, the sleeve having a bottom portion sized to fit over a respective one of the supports.

6. The crib of claim 3 wherein the crib assembly further comprises a plurality of crib legs connected to the crib side for supporting the crib assembly, each respective one of the supports being a top portion of a respective one of the crib legs.

7. The crib of claim 6 wherein the side comprises a plurality of side members connected to each other head to tail to form the crib side, each of the crib legs being connected to two adjacent side members.

8. The crib of claim 3 wherein an outer perimeter of the crib side is substantially a circle.

9. The crib of claim 8 wherein at least one of the plurality of side members is movable to provide easier access for placing and removing a child from the base of the crib, the plurality of side members extending upwards from and surrounding the crib base.

10. The crib of claim 9 wherein the crib assembly further comprises a pair of angled rods extending vertically through the at least one movable side member for guiding said member in a substantially vertical direction.

11. The crib of claim 6 wherein the plurality of crib legs, including each respective support, are made entirely of wood.

12. The crib of claim 11 wherein each canopy leg includes a post and a sleeve, the sleeve having a top portion joined to a bottom portion of the post, the sleeve having a bottom portion sized to fit over a respective one of the supports.

13. A kit of parts for a canopy crib, comprising:

a canopy assembly to be removably connected to a crib assembly, the canopy assembly having a canopy and a plurality of canopy legs to be removably connected to a top of the crib assembly at one end and to a bottom of the canopy at another end to support the canopy above the crib assembly;

the crib assembly having a plurality of supports, a lower portion of each of the canopy legs removably fit over one of the supports;

a plurality of caps to be placed over the supports when the canopy assembly has been removed; and wherein an opening is defined between an adjacent pair of the canopy legs, the canopy, and the crib assembly that allows the placement and removal of a child through the opening and into and out of the crib assembly.

14. The kit of claim 13 wherein each canopy leg includes a post and a sleeve, the sleeve having a top portion joined to and covering a bottom portion of the post, the sleeve having a bottom portion sized to fit over one of the supports to support the canopy assembly.

15. The kit of claim 13 wherein the caps are made of metal.

16. The kit of claim 13 wherein the crib assembly includes a plurality of movable side members and fixed side members that once installed extend upwards from and surround a base for containing the child in the crib assembly.

17. The kit of claim 16 further comprising a pair of angled rods to extend vertically through one of the movable side members for guiding the movable side member in a vertical direction.

18. The kit of claim 13 wherein each of the caps has a hole that lines up with an opening in a respective one of the supports, at least one of the pair of angled rods to be fastened to one of the supports through the hole and the opening to secure the cap to the support.

19. The kit of claim 13 wherein the crib assembly includes a plurality of crib legs for supporting the crib assembly, each of the supports being a top portion of a respective one of the crib legs.

* * * * *

UNITED STATES PATENT AND TRADEMARK OFFICE

CERTIFICATE OF CORRECTION

PATENT NO. : 6,131,217

DATED : October 17, 2000

INVENTOR(S) : Kasem

It is certified that error appears in the above-identified patent and that said Letters Patent is hereby corrected as shown below:

Column4, line 9, please insert -- the canopy assembly -- after "removing".

Column 4, line 47, please delete "claim 8" and insert -- claim 7 --.

Column 6, line 9, please delete "claim 13" and insert -- claim 17 --.

Signed and Sealed this

First Day of May, 2001

*Attest:*

Nicholas P. Godici

NICHOLAS P. GODICI

*Attesting Officer*

*Acting Director of the United States Patent and Trademark Office*